US006671473B2

(12) United States Patent
Miyabe

(10) Patent No.: US 6,671,473 B2
(45) Date of Patent: Dec. 30, 2003

(54) DEVELOPING APPARATUS PROVIDED WITH SEAL FUNCTIONS ON BOTH SIDES OF DEVELOPING ROLLER

(75) Inventor: Shigeo Miyabe, Shizuoka (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 10/084,457

(22) Filed: Feb. 28, 2002

(65) Prior Publication Data

US 2003/0012580 A1 Jan. 16, 2003

(30) Foreign Application Priority Data

Mar. 1, 2001 (JP) ..... 2001-056572

(51) Int. Cl.[7] ..... G03G 15/08
(52) U.S. Cl. ..... 399/104; 399/111
(58) Field of Search ..... 399/103, 104, 399/105, 106, 111, 119

(56) References Cited

U.S. PATENT DOCUMENTS

| | | | | |
|---|---|---|---|---|
| 5,742,875 A | | 4/1998 | Bogoshian et al. | 399/104 |
| 6,029,030 A | * | 2/2000 | Yamaji et al. | 399/104 |
| 6,185,393 B1 | | 2/2001 | Karakama et al. | 399/103 |

FOREIGN PATENT DOCUMENTS

| | | | |
|---|---|---|---|
| JP | 57-30859 | | 2/1982 |
| JP | 08-137275 | * | 5/1996 |
| JP | 08-166719 | * | 6/1996 |

* cited by examiner

*Primary Examiner*—Sophia S. Chen
(74) *Attorney, Agent, or Firm*—Fitzpatrick, Cella, Harper & Scinto

(57) ABSTRACT

The developing apparatus has a rotatable developer bearing member, a bearing member for holding the developer bearing member rotatably, and a seal member for preventing a leakage of a developer from an end portion of the developer bearing member in a lengthwise direction thereof to the lengthwise direction. In the developing apparatus, the seal member is located by the bearing member.

12 Claims, 16 Drawing Sheets

DEVELOPING APPARATUS PROVIDED WITH SEAL FUNCTIONS ON BOTH SIDES OF DEVELOPING ROLLER

BACKGROUND OF THE INVENTION

1. Field of the Invention

The present invention relates to a developing apparatus to be mounted in an image forming apparatus, which uses a recording technique such as an electrophotographic process, an electrostatic recording process or the like, like a copying machine, a printer and the like. In particular, the present invention relates to a developing apparatus suitable for being mounted in a process cartridge capable of being detachably attachable to an image forming apparatus.

2. Related Art

An image forming apparatus using an electrophotography requires maintenance, such as the exchange of its photosensitive body drum, the replenishment or the exchange of its developer, the adjustment, the cleaning or the exchange of its other parts (its charger, its cleaner container, or the like), when the image forming apparatus has been used for a long time. It is practically difficult for a person other than a serviceperson having an expert knowledge to do such maintenance work.

Accordingly, an image forming apparatus employing an electrophotographic image forming process has employed a process cartridge system in which an electrophotographic photosensitive body and process means working on the electrophotographic photosensitive body are integrally formed to be a cartridge and the cartridge is made to be detachably attachable to the main body of the image forming apparatus. Because the process cartridge system enables a user to perform the maintenance of the apparatus by himself or herself without relying on a serviceperson, the process cartridge system has been able to improve the operability of the image forming apparatus remarkably. Consequently, the process cartridge system is widely used in the image forming apparatus.

Thereby, when the maintenance of an aforesaid process device becomes necessary, a user himself or herself can simply maintain or exchange a process cartridge, and consequently, it has become able to obtain a high grade image quality cheaply and easily.

Developing means (or a developing apparatus) built in such a process cartridge is provided with seal members for preventing the outflow of toner to an area other than the developing area at both end portions of a developer bearing body such as a rotating developing roller mounted in the developing apparatus. An elastic body made of a felt, a expanded rubber or the like is widely used as a conventional seal member preventing the outflow of toner.

A developing roller is provided with a magnet roller therein, and is rotatably supported by a developing container with sleeve bearings. Consequently, toner fed from the developing container attaches to the surface of the developing roller by a magnetic force of the magnet roller. After the thickness of the attached toner layer has been regulated by a developing blade, the toner attaches to a latent image on a photosensitive drum at a position opposed to the latent image on the photosensitive drum as the developing roller rotates. Consequently, the latent image is developed.

The developing apparatus is further provided with elastic seal members attached at both end portions of the developing roller at the outsides of the developing area in the lengthwise direction thereof and at the inner part on the side opposite to the opening side of the developing roller attached to a developing frame body of the developing apparatus. The elastic seal member is pressed to the outer peripheral surface of the developing roller for preventing the outflow of toner.

As for the aforesaid contact type seal members, because the elastic seals are pressed to the half of the outer peripheral surface of the developing roller, the conventional developing apparatus has the problem such that the load of the developing roller, which rotates at the time of a developing operation, is large, and the problem such that the elastic seal members deteriorate owing to the contact with the developing roller to make the sealing performance of the elastic seal members worse. Moreover, toner sometimes enters into the gaps between the developing roller and the elastic seal members, although the amount of the so entering toner is small. The invasion of the toner sometimes causes an increase of torque or an increase of fluctuations of torque to produce the unevenness of the rotations of the developing roller. And then, a bad influence is sometimes exerted upon image formation.

Accordingly, for solving those problems, a noncontact type seal member has been proposed. In the noncontact type seal member, seal members made of a magnetic body (hereinafter referred to as "magnetic seals") are disposed at both end portions of the developing roller with predetermined spaces between them for preventing the outflow of toner.

The magnetic seal is made of a magnet. The magnetic seals are attached to both end portions of the developing roller in the state of being wound around the end portions for being disposed with a predetermined gap (about 0.1 mm to 0.7 mm) to the outer peripheral surface of the developing roller. The magnetic seals are attached to the developing container in the wound state along with the developing roller. The surfaces of the magnetic seals opposed to the developing roller are magnetized. Magnetic brushes formed by chained toner formed along each line of magnetic force fill up the gaps between the outer peripheral surface of the developing roller and the surfaces of the magnetic seals to prevent the outflow of toner from the developing area.

Moreover, because it is needed to locate the magnetic seals highly precisely to the developing roller, various locating methods have conventionally been devised.

Incidentally, in both cases of the use of the aforesaid contact type seal member and the use of the noncontact type seal member, high accuracy of the attachment of them to the main body of the developing apparatus is required for securing their seal performances.

SUMMARY OF THE INVENTION

The present invention was made in consideration of the aforesaid problems, and an object of the invention is to provide a developing apparatus in which toner does not easily leak out.

Another object of the invention is to provide a developing apparatus in which seal members for preventing the leakage of the toner from the end portions of the developing roller can be attached with high accuracy.

A further object of the invention is to provide a developing member to which seal members for preventing the leakage of toner from the end portions of its developing roller can be attached simply and accurately.

A still further object of the invention is to provide a developing apparatus in which the positional accuracy of seal members to its developing roller is high.

A still further object of the invention is to provide a developing apparatus including a rotatable developer bearing member, a bearing member for holding the developer bearing member rotatably, and a seal member for preventing the leakage of a developer from an end portion of the developer bearing member in the lengthwise direction thereof into the lengthwise direction, wherein the seal member is located by the bearing member.

The still further object of the invention will be more apparent from the following detailed description taken in conjunction with the accompanying drawings.

DESCRIPTION OF THE PREFERRED EMBODIMENTS

FIG. 1 to FIG. 17B are referenced while an preferred embodiment of the present invention is described.

Description of Process Cartridge and Apparatus Main Body

Figure 1:
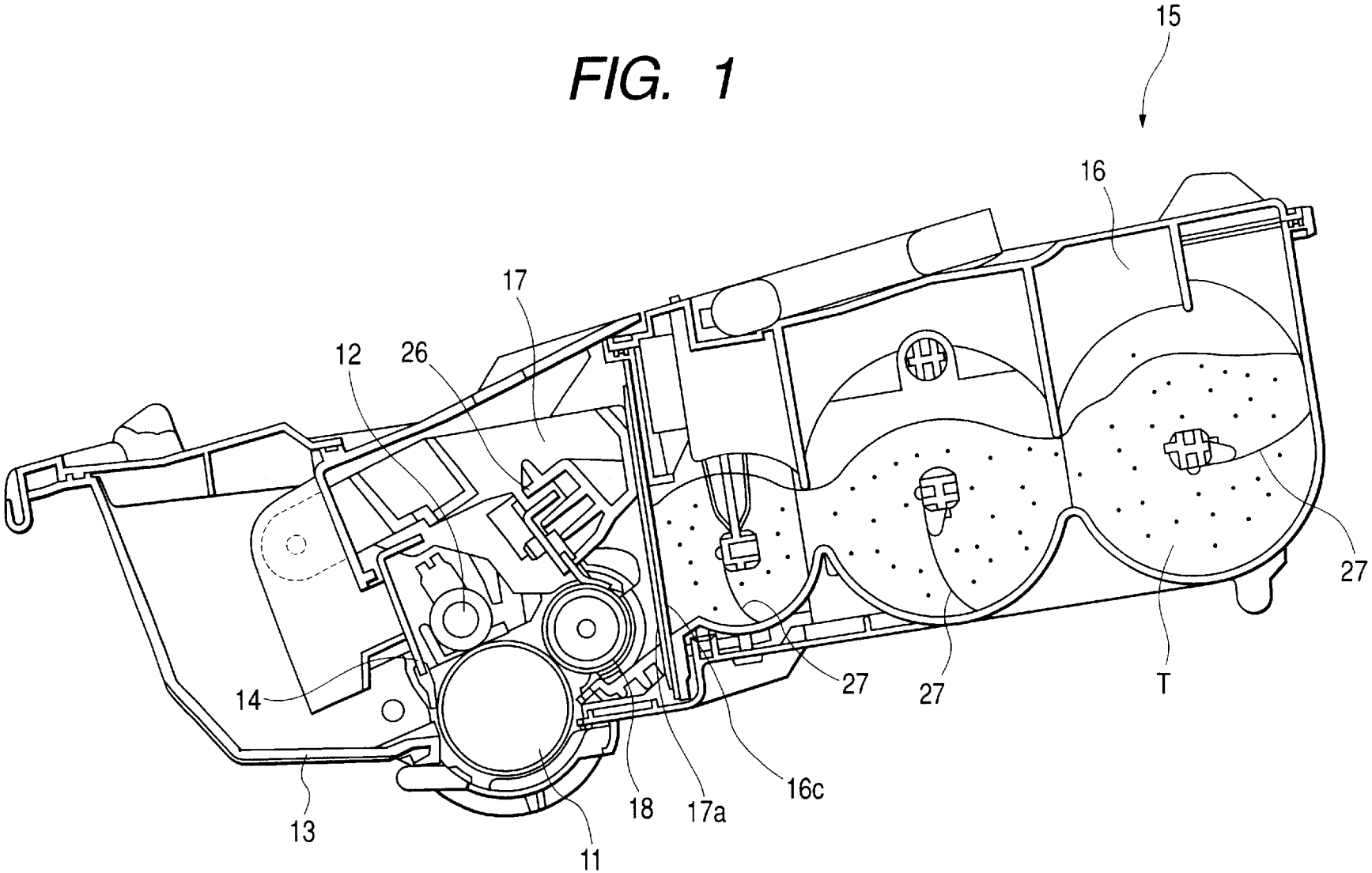
FIG. 1 is a schematic diagram of the principal section of a process cartridge according to an embodiment of the present invention.
Figure 2:
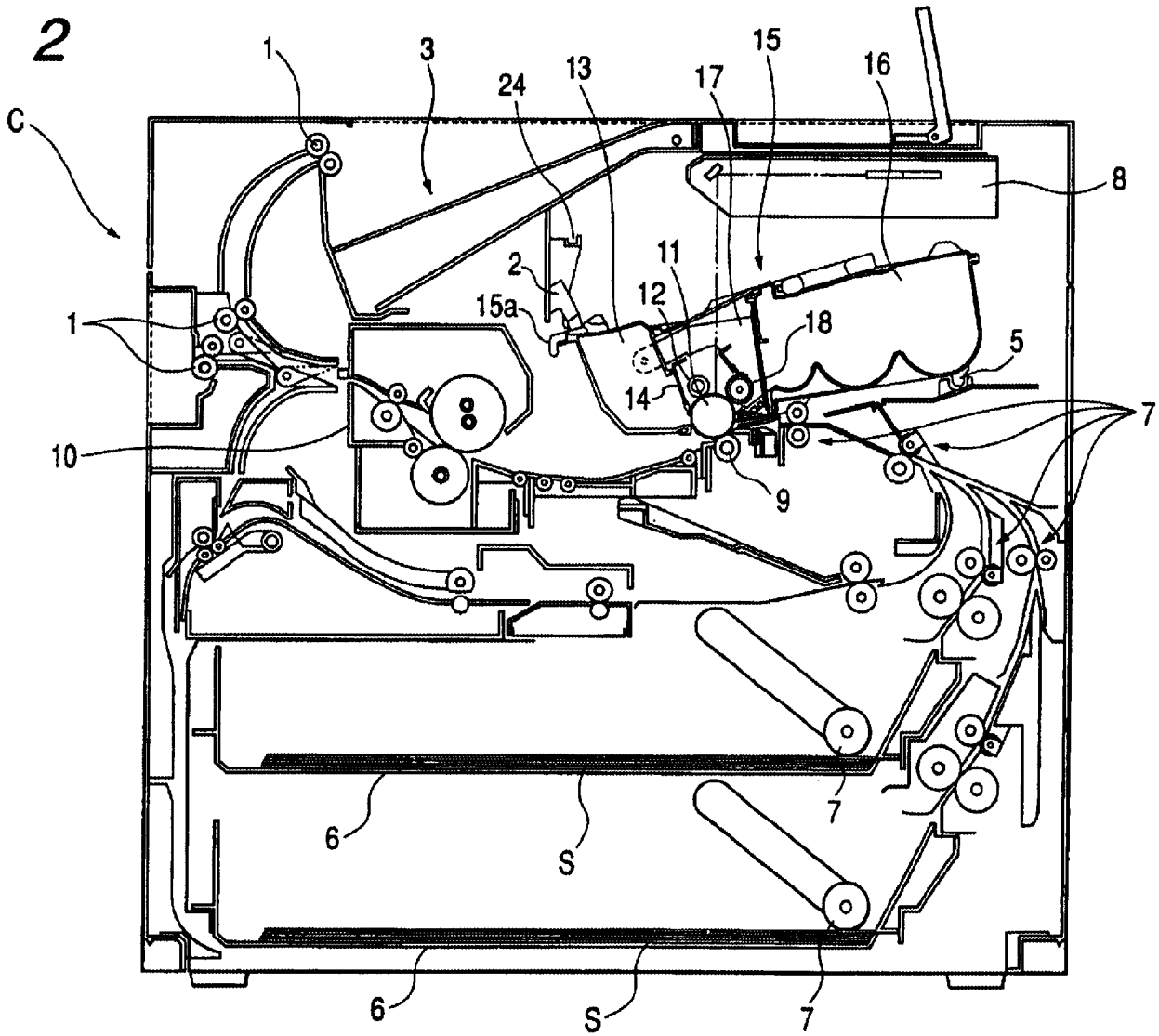
FIG. 2 is a schematic diagram of the principal section of the apparatus main body according to the embodiment of the invention.
Figure 3:
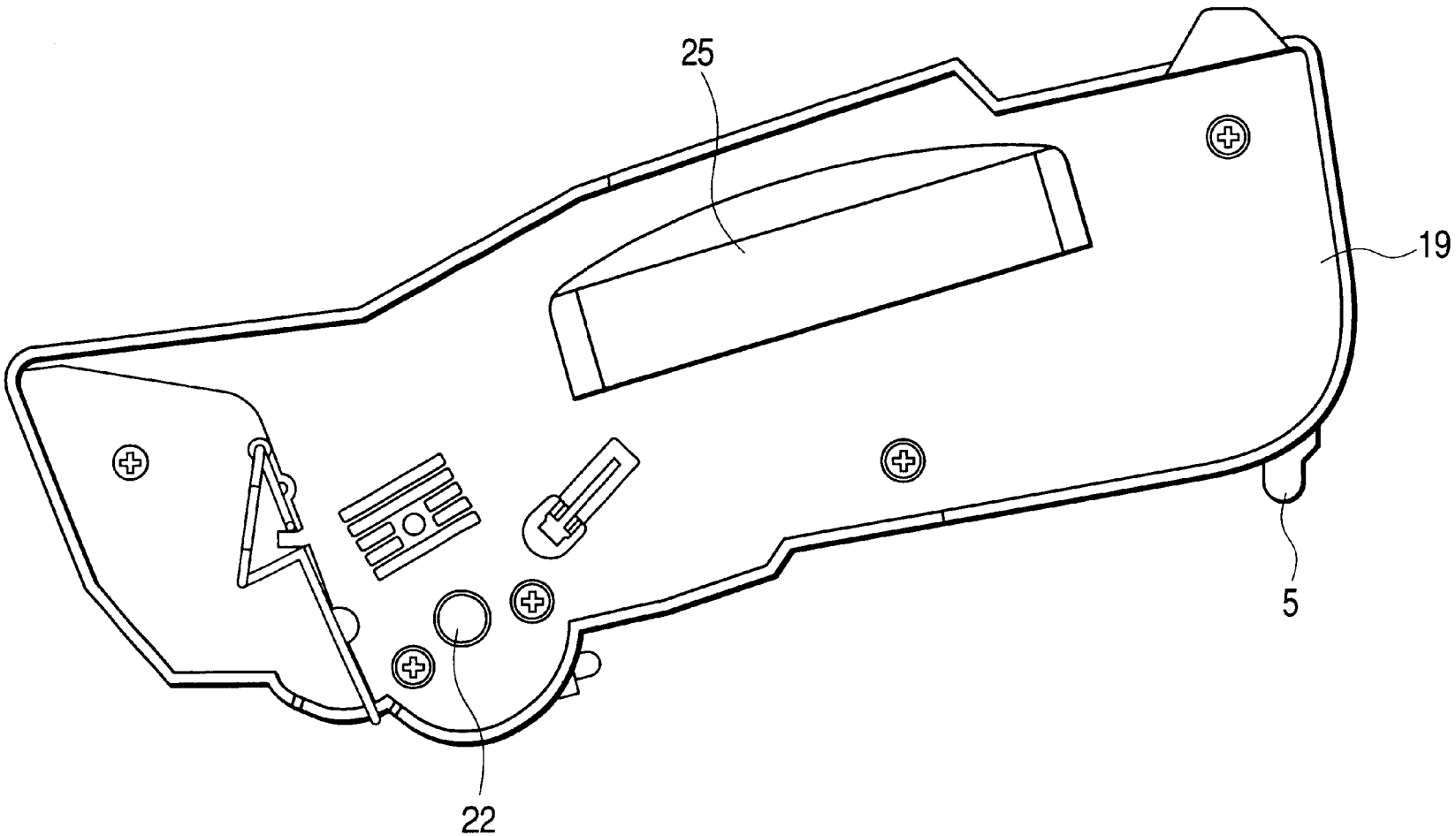
FIG. 3 is a side elevation showing the process cartridge of the embodiment of the invention seen from a side face thereof.

FIG. 1 is a diagram of the principal section of a process cartridge according to the present invention, and FIG. 2 is a diagram of the principal section of an image forming apparatus according to the invention. The process cartridge is equipped with an image bearing body and process means working on the image bearing body. The process means includes, for example, charging means for charging the surface of the image bearing body, a developing apparatus for forming a toner image on the image bearing body, and cleaning means for removing the toner remaining on the surface of the image bearing body.

The process cartridge 15 of the present embodiment disposes, as shown in FIG. 1, a charging roller 12 being the charging means; a developing roller 18, a developing blade 26 and a toner containing frame body 16 for containing toner as the developing means; and a cleaning blade 14 as the cleaning means around the electrophotographic photosensitive body drum (hereinafter referred to as a "photosensitive body drum") 11 being the image bearing body. Each component is integrally covered by a housing to be the process cartridge 15. The process cartridge 15 is configured to be detachably attachable to an image forming apparatus main body C.

FIG. 2 shows the image forming apparatus in the state capable of forming an image after the process cartridge 15 has been mounted in the apparatus main body C. The process cartridge 15 can be detached from the apparatus main body C in conformity with the following procedures. That is: at first, a hoist arm 2 capable of supporting the left side end portion of the process cartridge 15 is raised with a not shown handle to swing the process cartridge 15 on a guide rail 24 of the apparatus main body C around a fulcrum foot 5 of the process cartridge 15; a guide portion 15*a* of the process cartridge 15 is thereby made to accord with a guide rail 24 of the apparatus main body C; and then the process cartridge 15 is pulled out toward the front side of FIG. 1 by a user, being gripped by the user's hand on a handle 25 (see FIG. 3).

The attachment of the process cartridge 15 to the apparatus main body C is performed in conformity with the reverse procedures of the procedures at the detachment thereof described above.

The process cartridge 15 is used for image formation in the state of being mounted in the apparatus main body C shown in FIG. 2. The image formation is performed in conformity with the following procedures. That is, at first, a sheet S as a recording medium is conveyed from sheet cassettes 6 mounted at the lower part of the apparatus with conveying rollers 7, and an exposing apparatus 8 selectively exposes the photosensitive body drum 11, which has uniformly been charged by the charging roller 12, to light synchronously with the sheet conveyance for forming a latent image. After that, toner contained in the toner containing frame body 16 is carried toward the developing roller 18, and a thin toner layer is borne on the surface of the developing roller 18 with the developing blade 26. And then, a developing bias is applied to the developing roller 18 to feed toner on the surface of the photosensitive body drum 11 according to the latent image. The toner image on the photosensitive body drum 11 is then transferred to the conveyed sheet S by the application of a bias voltage to a transferring roller 9. The sheet S is conveyed to a fixing apparatus 10, and the toner image transferred on the sheet S is fixed by the fixing apparatus 10. Then, the sheet S is delivered to a discharging portion 3 at the upper part of the apparatus by discharging rollers 1.

Frame Body Configuration of Process Cartridge

Figure 7:
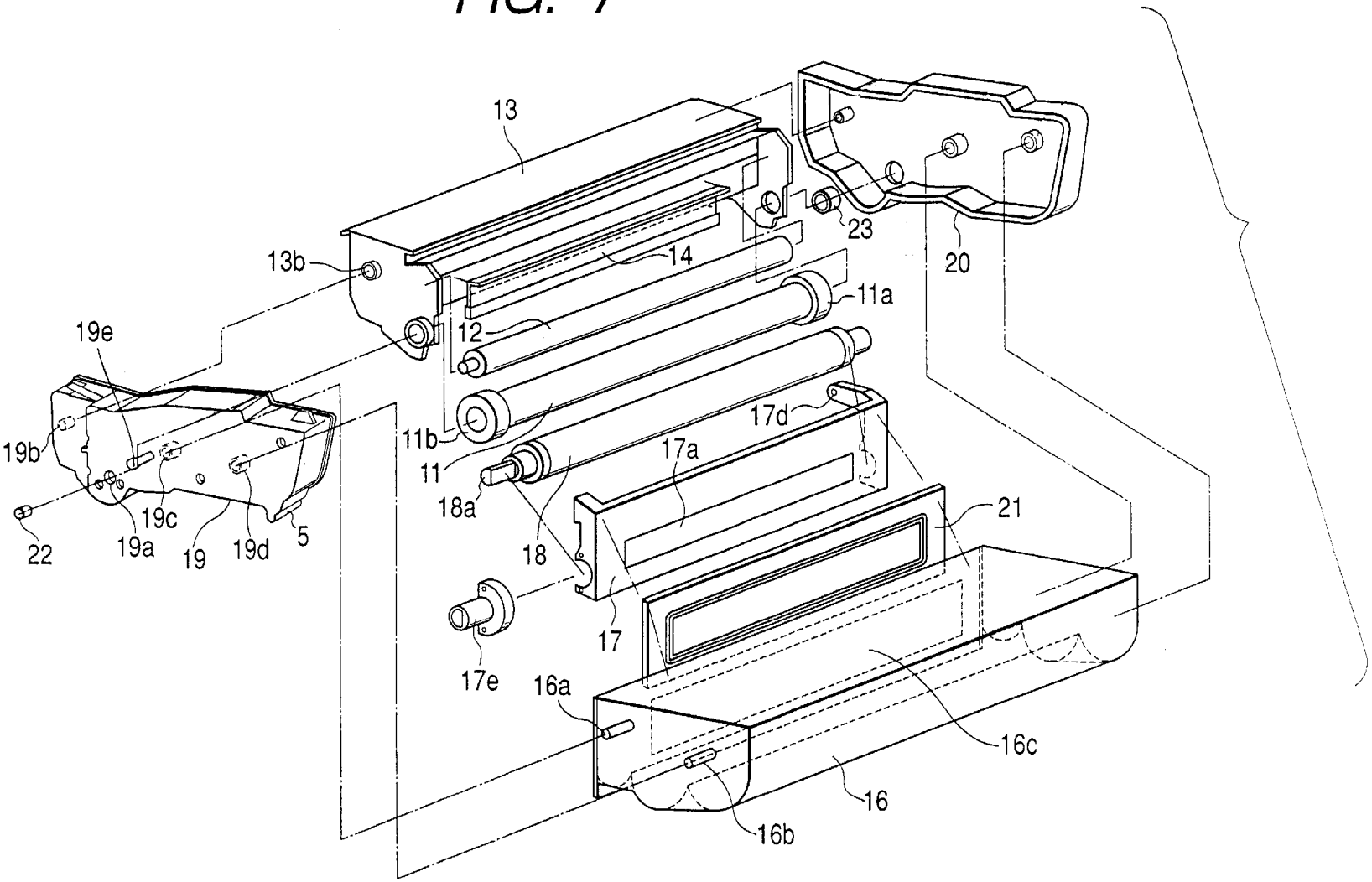
FIG. 7 is a disassembled perspective view of a process cartridge frame body in the embodiment of the invention.

FIG. 1 and FIGS. 3 to 7 are referred while the configuration of the process cartridge 15 is described. FIG. 7 is a perspective view showing the frame configuration of the process cartridge 15 before it is assembled. The process cartridge 15 is chiefly composed of three frame bodies: a cleaning frame body 13 in which the photosensitive body drum 11, the charging roller 12 and the cleaning blade 14 are integrally incorporated; a developing frame body 17 in which the developing roller 18 and the developing blade 26 (not shown in FIG. 7. See FIG. 1) are integrally supported; and the toner containing frame body 16 containing toner T therein. Moreover, side covers 19 and 20 for supporting the three frame bodies 13, 17 and 16 integrally fix them on both the side faces of them to constitute the process cartridge 15.

Figure 4:
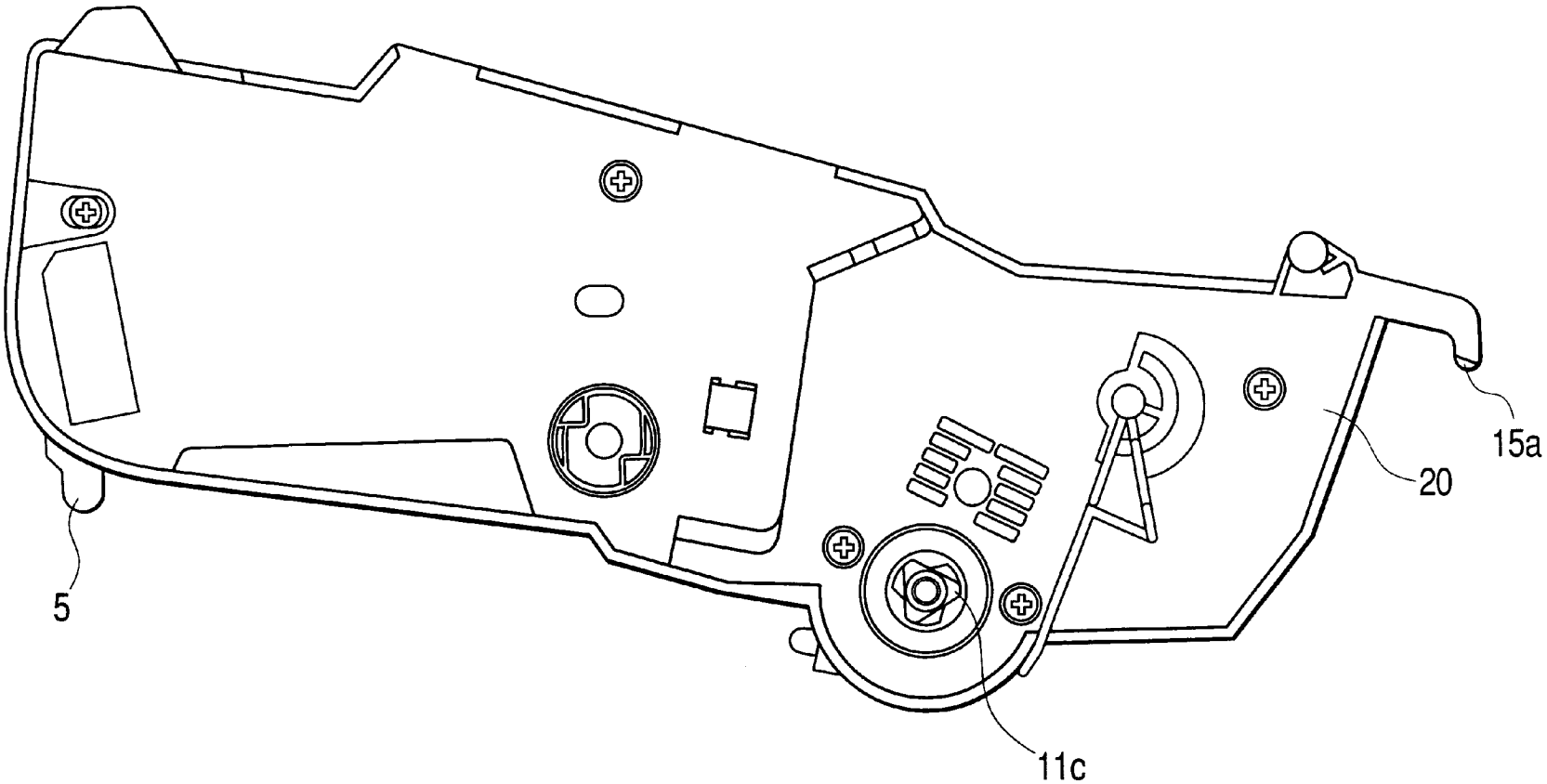
FIG. 4 is a side elevation showing the process cartridge of the embodiment of the invention seen from another side face thereof.
Figure 5:
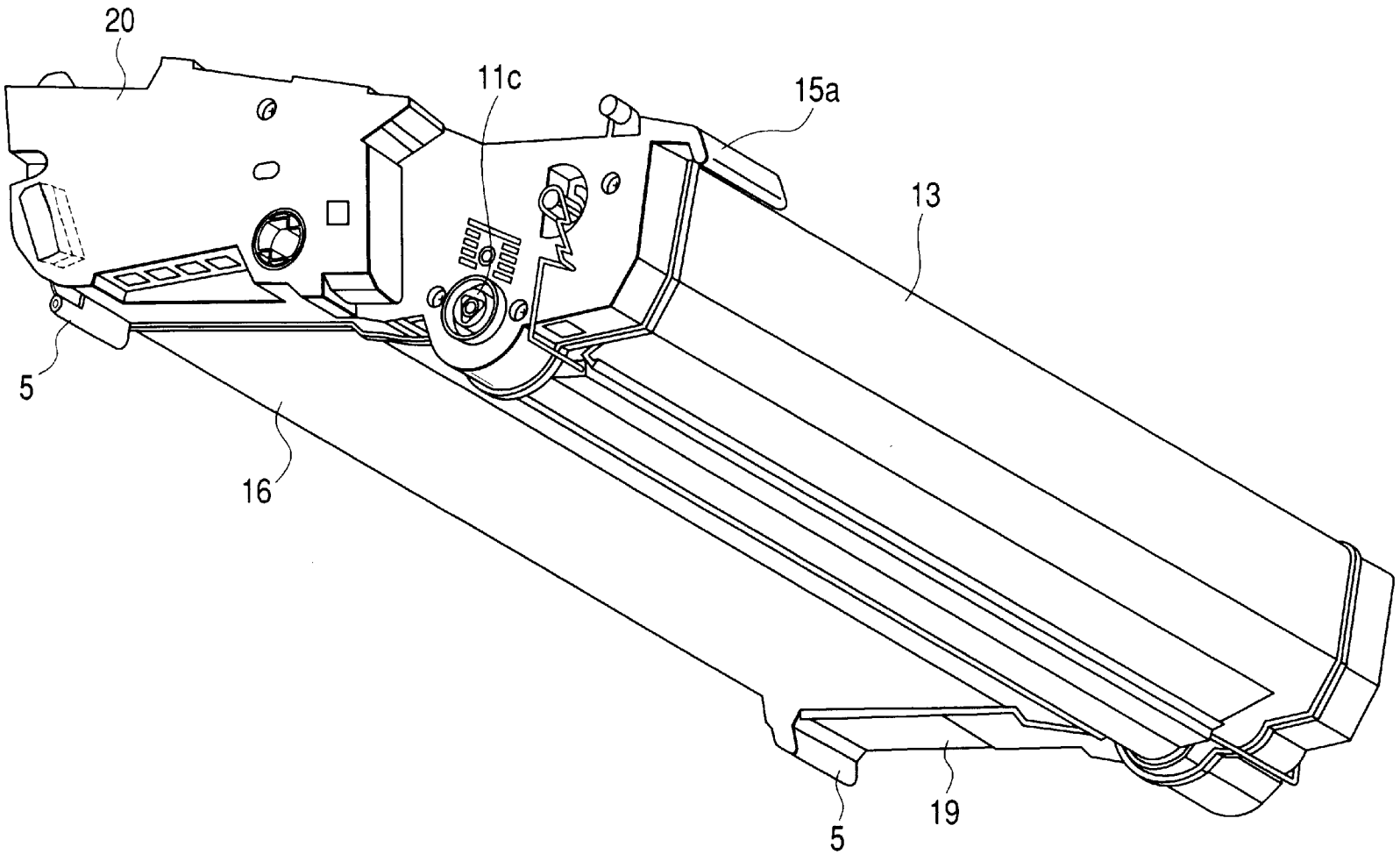
FIG. 5 is a perspective view of the process cartridge in the embodiment of the invention.
Figure 6:
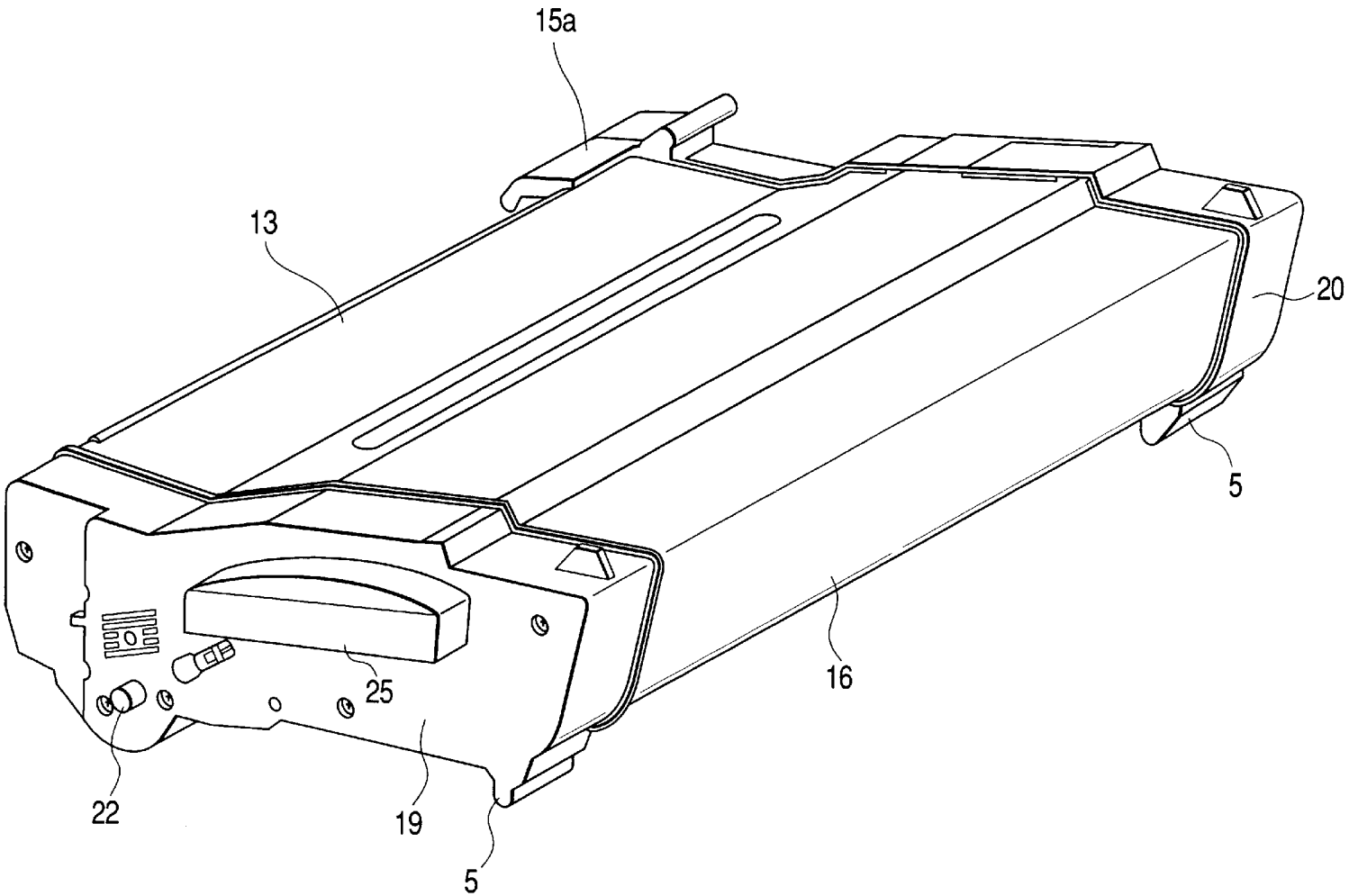
FIG. 6 is another perspective view of the process cartridge in the embodiment of the invention.

The cleaning frame body 13 fixes the cleaning blade 14 with machine screws or the like thereto, and supports the charging roller 12 rotatably at the core metal portions on both end portions of the charging roller 12 with bearing members (not shown) being put between the cleaning frame body 13 and the charging roller 12. Moreover, the cleaning frame body 13 rotatably supports the photosensitive body drum 11 at flange portions 11*a* and 11*b* on both end portions of the photosensitive body drum 11 with bearing members 22 and 23 being put between the cleaning frame body 13 and the photosensitive body drum 11. Incidentally, as shown in FIG. 4 and FIG. 5, the flange portion 11*a* supports the so-called triangle coupling 11*c* to engage with a driving coupling of the apparatus main body C at an end portion of the flange portion 11*a*, and the flange portion 11*a* is driven from a driving apparatus in the apparatus main body C through the triangle coupling 11*c* to drive the photosensitive body drum 11. The toner containing frame body 16 contains toner T in its inside together with toner carrying members 27.

The developing roller 18 including a magnet roller 18*a*, the developing blade 26 and a magnetic seal (not shown in FIG. 7) are disposed in the developing frame body 17. One side end of the magnet roller 18*a* is supported by a projecting portion 17*e* being a developing roller bearing of the developing frame body 17 and the other side end thereof is supported by the developing frame body 17, and the magnet roller 18*a* keeps a gap with the developing roller 18. The developing roller 18 is configured to perform the electric power supply thereto through an electric contact point disposed in the inside of the developing roller 18. Moreover, an anti-climbing roller (not shown) for keeping the interval from the photosensitive body drum 11 constant is provided on the developing roller 18.

The developing frame body 17 is supported by the cleaning frame body 13 swingably around a suspension hole 17*d* formed on one side face side of the developing roller 18 such that the center of the developing roller 18 goes toward the center of the photosensitive body drum 11.

Moreover, the process cartridge 15 is configured to pressurize the projecting portion 17*e*, which is fixed on a central axis line of the developing roller 18 in the lengthwise direction thereof on the other side face side of the developing frame body 17, toward the center of the photosensitive body drum 11. The projecting portion 17*e* is configured to be inserted into a groove 19*e* (an elongated hole in the shape of a straight line substantially parallel in the center direction of the photosensitive body drum 11 in the present embodiment) formed on the side cover 19 in the state movable to the center direction of the photosensitive body drum 11. Moreover, an elastic member (not shown) is disposed in the inside of the groove 19*e* such that the elastic body pressurizes the projecting portion 17*e* to bias the developing roller 18 along the photosensitive body drum 11.

On the other hand, the groove 19*e* also has the role of a locating hole for regulating the moving direction of the developing roller 18.

When a driving force works on the process cartridge 15, high gears (not shown), which are respectively provided on the photosensitive body drum 11 and the developing roller 18, and mesh with each other, are designed to receive a force respectively in the direction of interlocking with each other around the suspension hole 17*d* lest the forces should work in the direction to separate the photosensitive body drum 11 and the developing roller 18 from each other. Moreover, the elastic member provided in the groove 19*e* also pressurizes the developing roller 18 toward the photosensitive body drum 11 at all times.

The side cover 19 on one side has a size covering a principal section of the process cartridge 15. The side cover 19 is disposed on one end of the process cartridge 15 in the lengthwise direction. The side cover 19 integrally supports the cleaning frame body 13 and the toner containing frame body 16 by fixing them thereto respectively. A hole portion 19*a* in the side cover 19 is located on the same axis as that of the center of the photosensitive body drum 11. At this time, if the location of the side cover 19 is performed by the use of the bearing member 22, the location can be determined highly precisely. Moreover, a locating portion 19*b* formed at a position distant from the photosensitive body drum 11 as far as possible locates the position of side cover 19 in the rotational direction thereof together with a locating portion 13*b* formed on a side face of the cleaning frame body 13, and the side cover 19 and the cleaning frame body 13 are fixed to each other with several machine screws. Furthermore, the toner containing frame body 16 forms locating portions 16*a* and 16*b* on its one end face. The toner containing frame body 16 is located to the side cover 19 by means of the locating portions 16*a* and 16*b* and locating portions 19*c* and 19*d* disposed on the side cover 19. The toner containing frame body 16 is fixed to the side cover 19 with several machine screws. The side cover 20 on the other side is similarly configured.

Moreover, the bearing member 22 also has the role of a locating member of the process cartridge 15 to the apparatus main body C. Opening portions 16*c* and 17*a* are respectively formed in the toner containing frame bode 16 and the developing frame body 17 for the supply of toner from the toner containing frame body 16 to the developing roller 18. The opening portions 17*a* and 16*c* in the developing frame body 17 and the toner containing frame body 16 are connected through a seal member 21. Moreover, the toner containing frame body 16 is located by the side covers 19 and 20, the developing frame body 17 is located by the cleaning frame body 13. There is consequently the possibility that distortion is produced in either of the developing frame body 17 and the toner containing frame body 16 owing to dimension errors between them. Accordingly, the seal member 21 is made from a flexible material. In such a configuration, if toner increases in the process cartridge 15, the load owing to the increased toner is imposed on the side covers 19 and 20, and no loads are imposed on the developing roller 18. Consequently, no surplus loads are imposed on the photosensitive body drum 11, and stable images can be obtained. Moreover, because the three frame bodies 13, 17 and 16 are connected to the side covers 19 and 20 on their side faces, the locations of the respective frame bodies 13, 17 and 16 can be determined by means of only the side covers 19 and 20. Consequently, the frame bodies 13, 17 and 16 can precisely be connected to each other.

Description of Developing Apparatus

Figure 8:
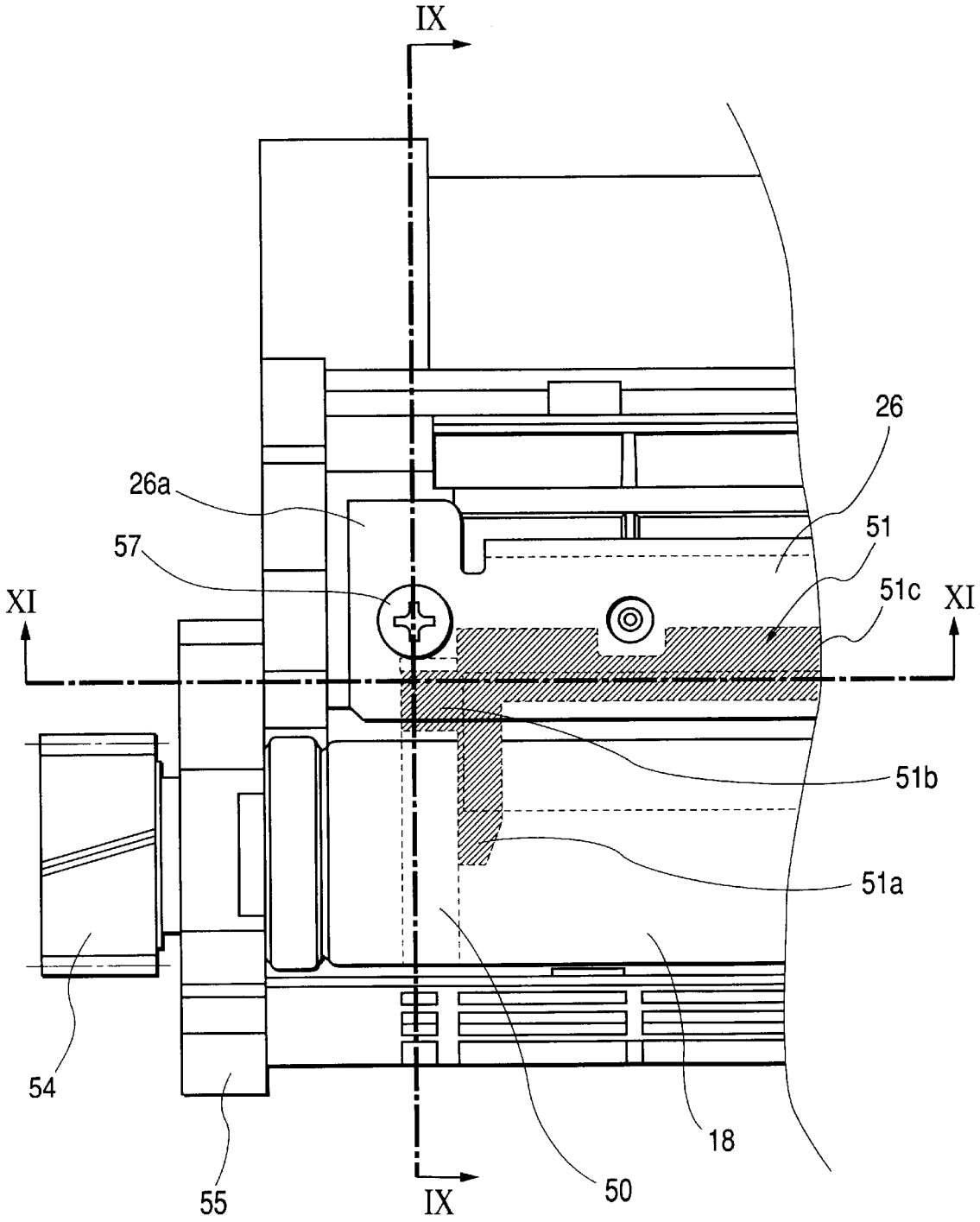
FIG. 8 is a front view of a developing apparatus.
Figure 9:
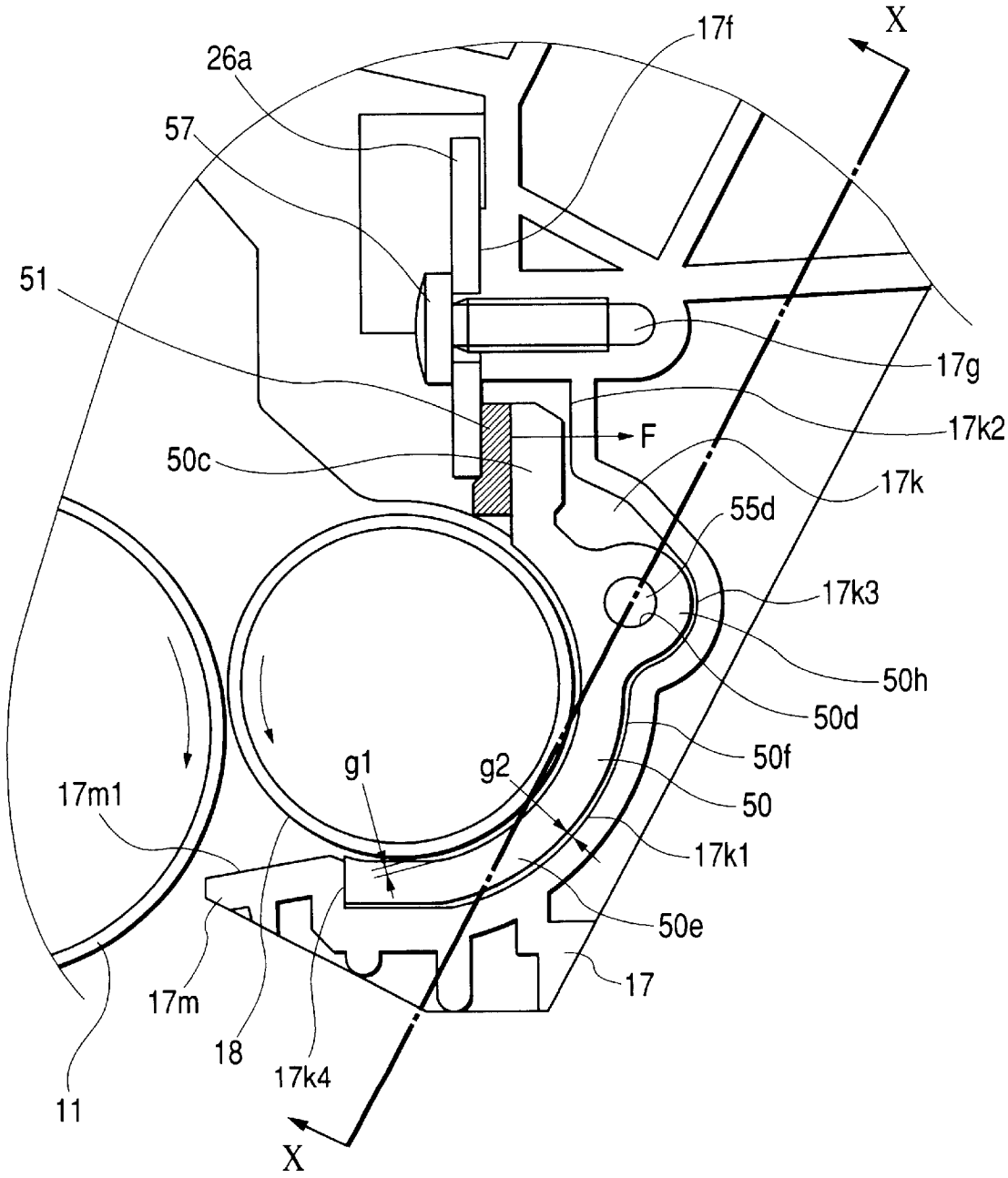
FIG. 9 is a sectional view of the developing apparatus taken along IX—IX line in FIG. 8.
Figure 10:
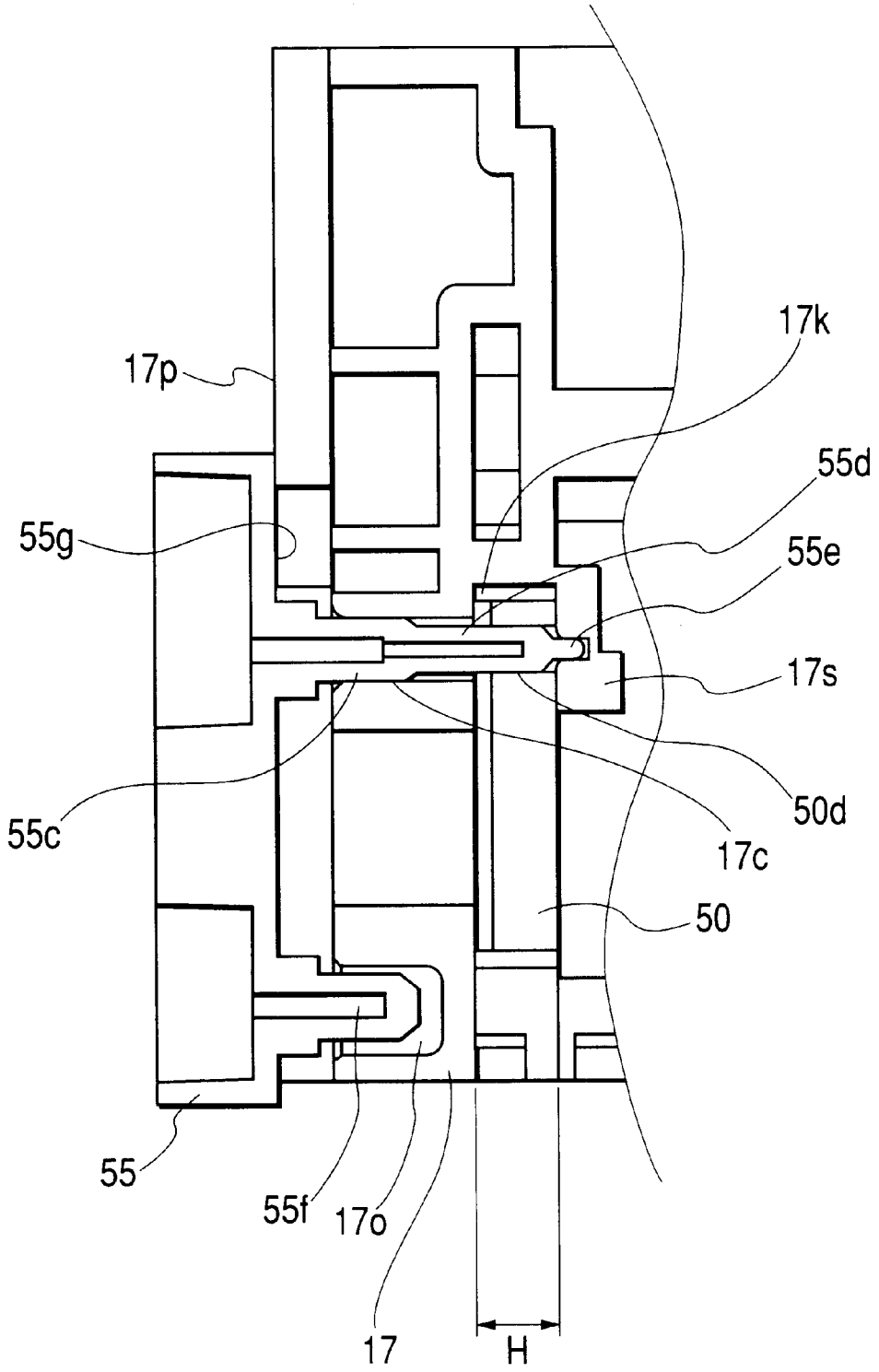
FIG. 10 is a sectional view of the developing apparatus taken along X—X line in FIG. 9.
Figure 11:
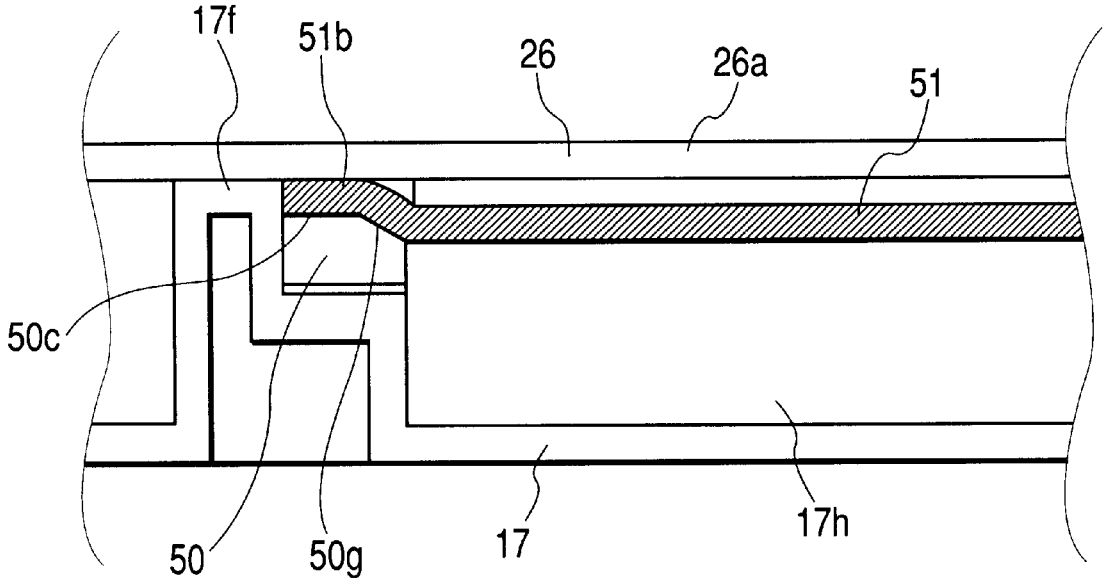
FIG. 11 is a sectional view of the developing apparatus taken along XI—XI line in FIG. 8.
Figure 12:
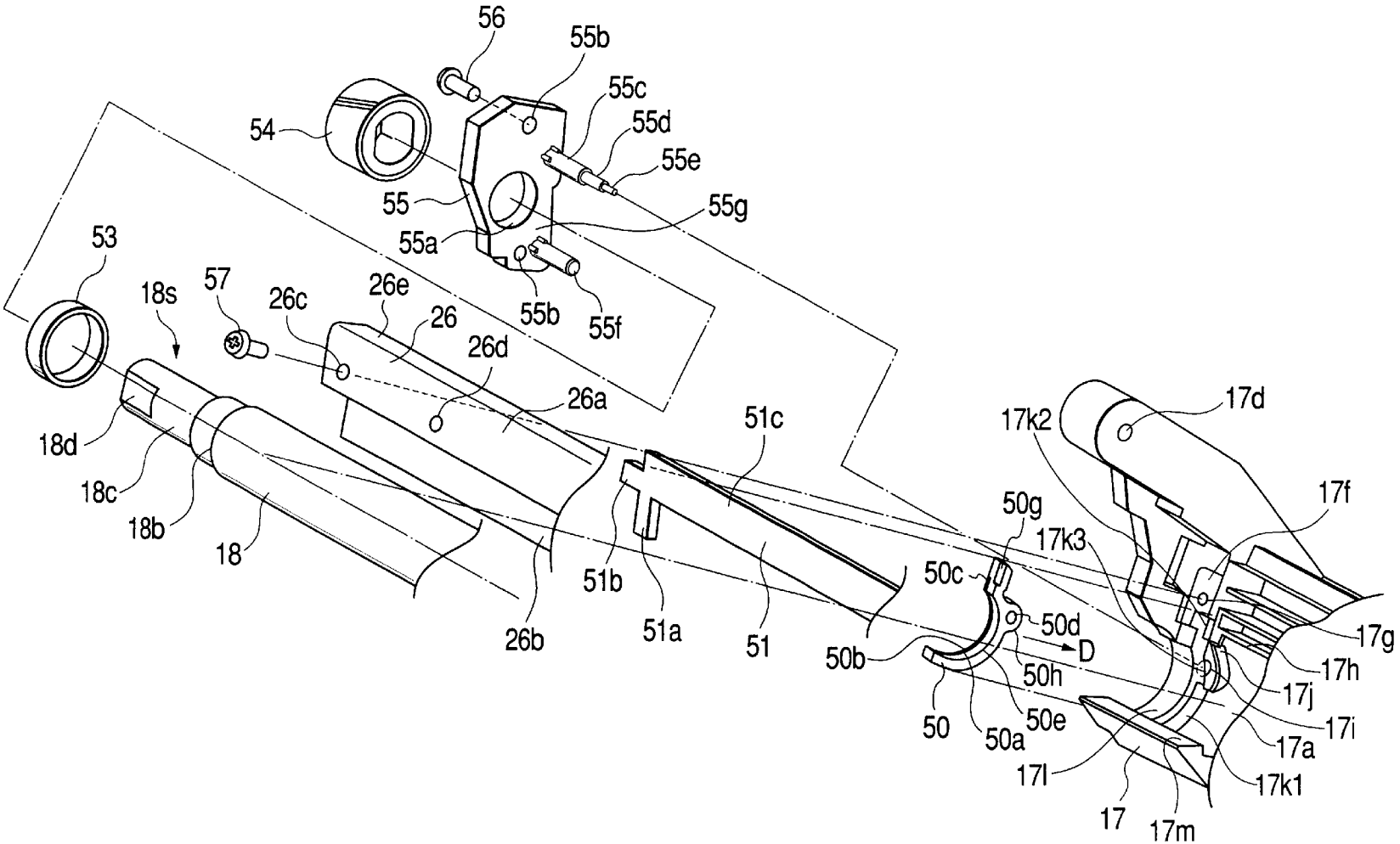
FIG. 12 is a perspective view showing a state of each part of the developing apparatus before they are assembled.
Figure 13:
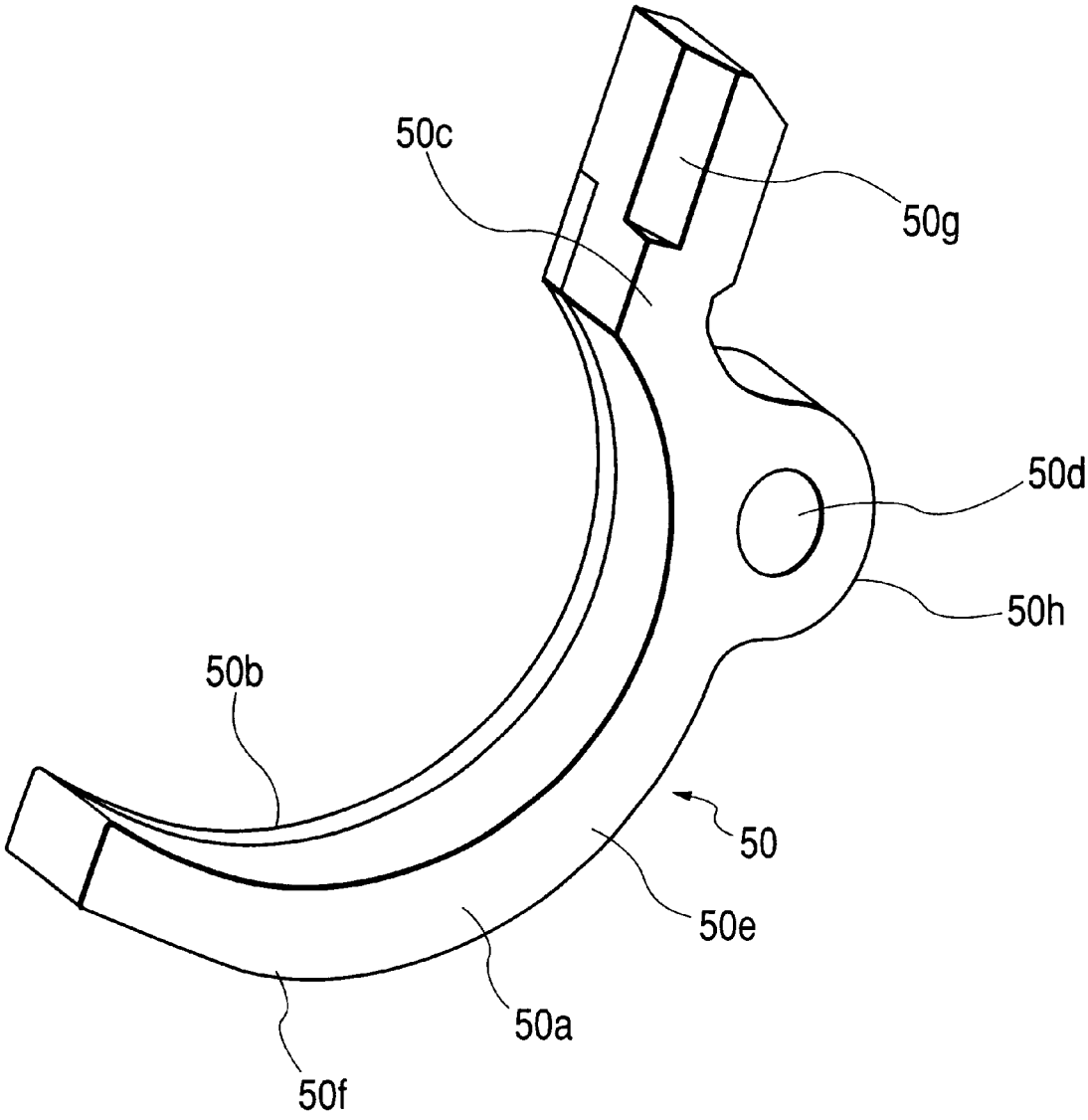
FIG. 13 is a perspective view of a simplex magnetic seal.
Figure 14:
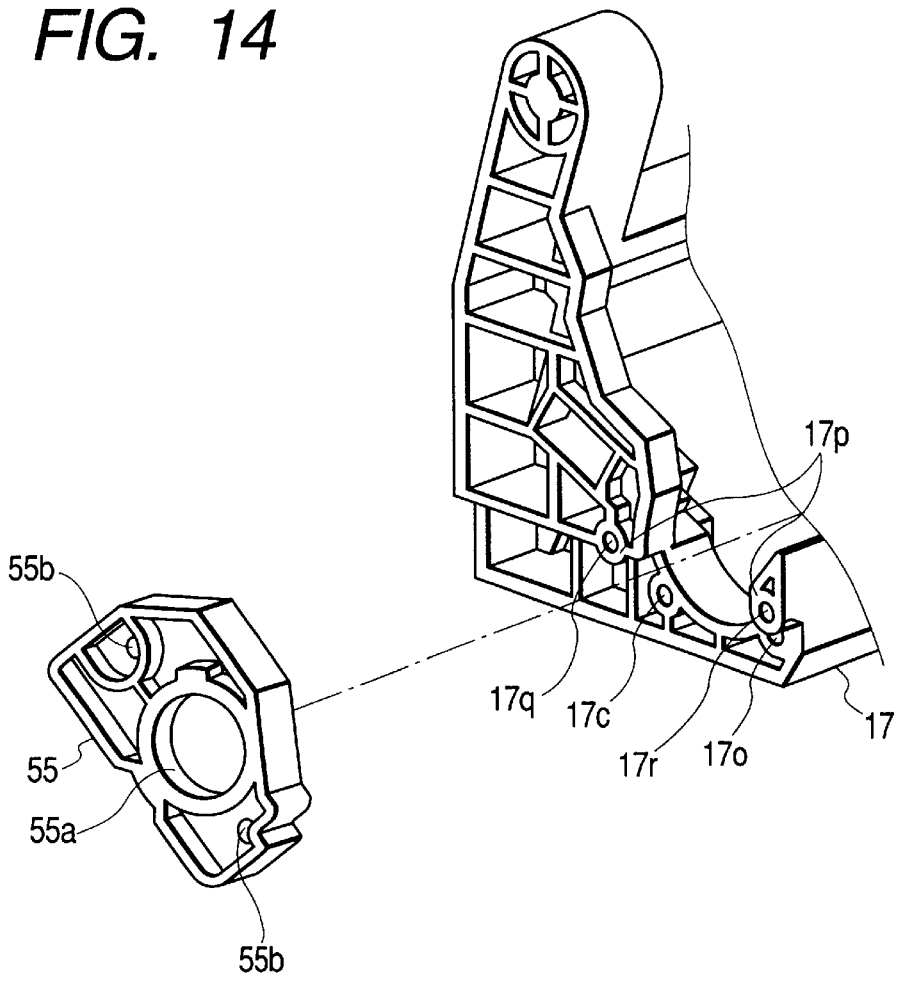
FIG. 14 is a perspective view showing only a developing bearing frame body and a developing frame body before they are assembled.
Figure 15:
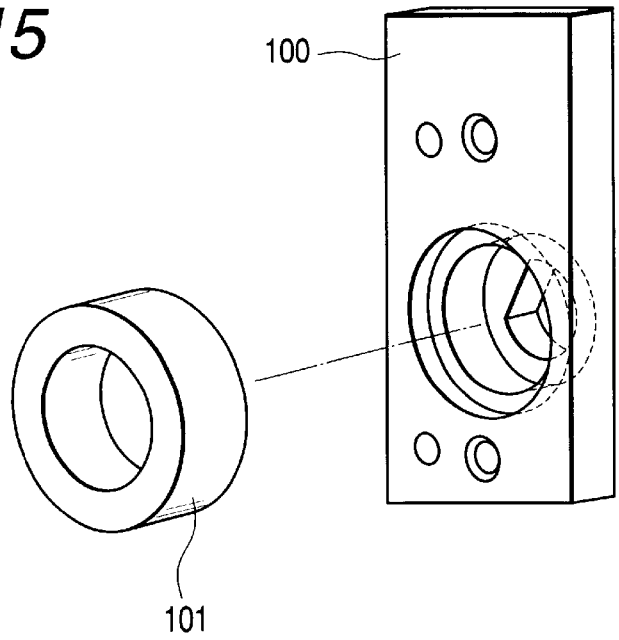
FIG. 15 is a perspective view of another embodiment of the developing bearing frame body.
Figure 16:
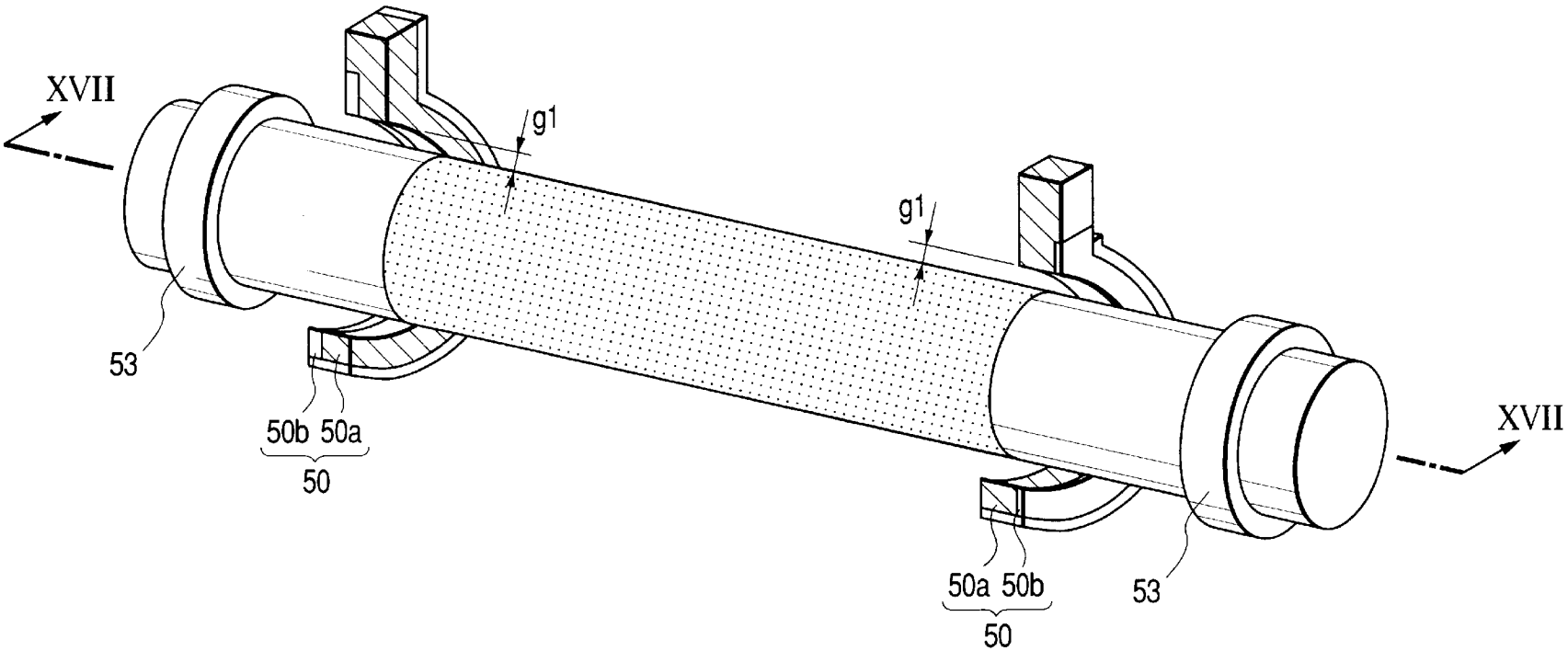
FIG. 16 is a perspective view showing only a developing roller and a magnetic seal.
Figure 17A:
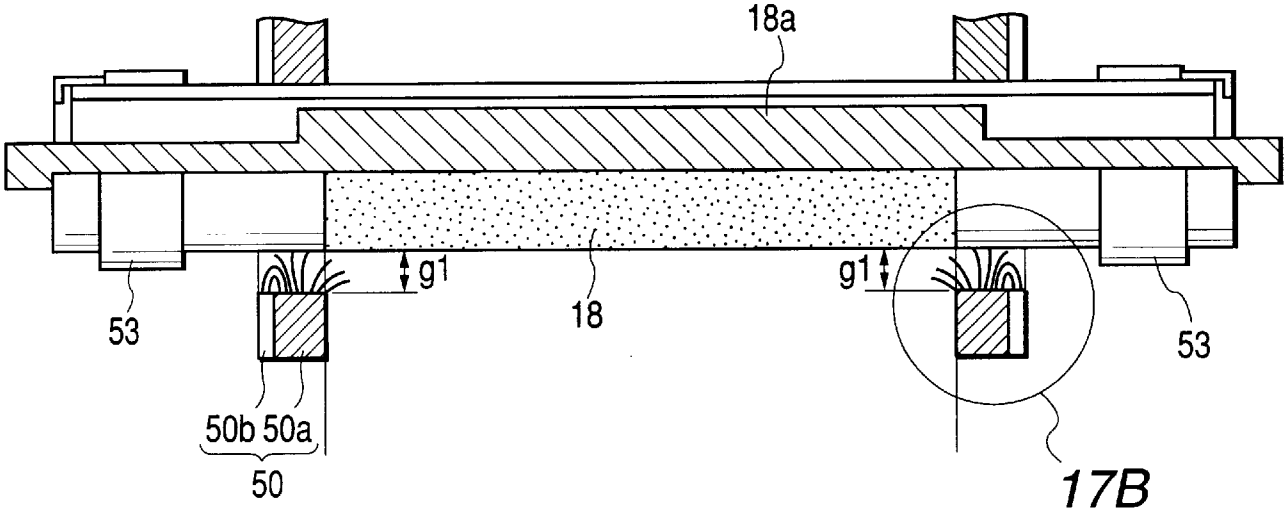
FIG. 17A is a sectional view of the developing roller and the magnetic seal taken along an XVII—XVII line in FIG. 16.
Figure 17B:
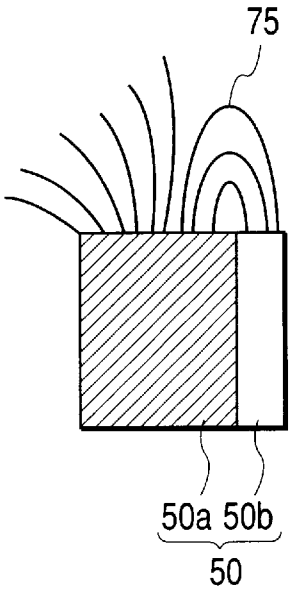
FIG. 17B is a macrograph of the part of 17B in FIG. 17A.

Next, the developing apparatus is described more minutely. FIG. 8 is a plan view of the developing apparatus seen from the direction orthogonal to the lengthwise direction of the developing roller 18. FIG. 9 is a sectional view of the developing apparatus taken along IX—IX line in FIG. 8. FIG. 10 is a sectional view of the developing apparatus taken along X—X line in FIG. 9. FIG. 11 is a sectional view of the developing apparatus taken along XI—XI line in FIG. 8. FIG. 12 is a perspective view showing a state of each part of the developing apparatus before they are assembled. FIG. 13 is a perspective view of a simplex magnetic seal. FIG. 14 is a perspective view showing only a developing bearing frame body and the developing frame body 17 before they are assembled. FIG. 15 is a perspective view of another embodiment of the developing bearing frame body. FIG. 16 is a perspective view showing only a developing roller and a magnetic seal. FIG. 17A is a sectional view of the developing roller and the magnetic seal taken along XVII—XVII line in FIG. 16, and FIG. 17B is a macrograph of the part of 17B in FIG. 17A.

As described above, the developing roller 18 and the developing blade 26 are incorporated into the developing frame body 17 as the components related to image formation.

As shown in FIG. 12, the developing blade 26 is composed of a sheet metal 26*a* having the thickness of about 1 mm to 2 mm and a polyurethane rubber 26*b* fixed on the sheet metal 26*a* by hot melt adhering or with a pressure sensitive adhesive double coated tape or the like. By the contact of the polyurethane rubber 26*b* with a generating line of the developing roller 18, the quantity of the toner on the peripheral surface of the developing roller 18 is regulated. Incidentally, a silicon rubber may be employed as the developing blade 26. Female screws 17*g* are provided on anti-climbing planes 17*f* formed in the developing frame body 17 as blade fitting portions, and dowels (not shown) for location are formed at positions near to the centers of the anti-climbing planes 17*f* a little. Accordingly, fitting holes 26*d* formed in the sheet metal 26*a* are fitted to the dowels (not shown) each other. After that, machine screws 57 are screwed into the female screws 17*g* through tapped holes 26*c* to fix the sheet metal 26*a* to the anti-climbing planes 17*f*. Thus, the position of the leading edge of the polyurethane rubber 26*b* is determined, and then the touching pressure of the polyurethane rubber 26*b* to the developing roller 18 is determined. Consequently, the distance from the leading edge of the polyurethane rubber 26*b* to the touching position is determined, and the development condition is determined. Moreover, one end of the sheet metal 26*a* of the developing blade 26 is bent by the angle of about 90 degrees to form a bent portion 26*e* for the heightening of the rigidity of the sheet metal 26*a* in order that the polyurethane rubber 26*b* is touched to the developing roller 18 uniformly in the lengthwise direction of the developing roller 18.

Incidentally, an elastic seal member 51, which is made from a moltopren (trade name) or the like and is formed in a shape of substantially a letter U, is stuck to the developing frame body 17 along its elastic seal seat surface 17*h* (see FIG. 12) at the upper part of the opening portion 17*a* in the lengthwise direction and its seat surfaces 17*j* in the widthwise direction for the prevention of the leakage of toner to the outside. A first straight line portion 51*c* of the elastic seal member 51 is stuck to the seat surface 17*h* of the developing frame body 17, and second straight line portions 51*a* of the seal member 51 are stuck to the seat surfaces 17*j*. The elastic seal member 51 is put between the developing frame body 17 and the developing blade 26 to be pinched out by them, and thereby the leakage of toner is prevented. Lug portions 51*b* are formed on the elastic seal member 51 at both end portions thereof to project from the end portions in the lengthwise direction of the seal member 51 by several millimeters. The lug portions 51*b* perform the role of locating the magnetic seal 50, which will be described later.

Moreover, as shown in FIG. 9 and FIG. 12, the magnetic seals 50 are attached to grooves 17*k* formed on the surfaces adjoining (at the insides of arc surfaces 17*l* in the lengthwise direction of the developing roller 18) to the arc surfaces 17*l* and flat surfaces continuing upward from the arc surfaces 17*l* along the peripheral direction of the developing roller 18 at both end portions of the opening portion 17*a* in the lengthwise direction of the developing roller 18. The magnetic seals 50 will be described later in detail.

Furthermore, a thin film elastic seal member (not shown), which abuts on a generating line of the developing roller 18, is stuck to a seat surface 17*m*1 in the upper part of a lower jaw portion 17*m* of the developing frame body 17.

The developing roller 18 is a cylindrical member made of a metal material of aluminum, stainless steel or the like. The outer diameter of the cylindrical shape of the developing roller 18 is about 16 mm to 20 mm, and the thickness of the cylindrical shape is about 0.5 mm to 1 mm. A surface treatment such as carbon coating, abrasive blasting or the like is performed to the surface of the developing roller 18 for the heightening of the electrification characteristic of developer. Only the carbon coating is performed in the present embodiment.

Sleeve flanges (only one end portion of them is shown in FIG. 12) 18*s*, which are stepped cylindrical members made of a metal material of aluminum, stainless steel or the like, are force-fitted into both end portions of the developing roller 18. Each of the sleeve flanges 18*s* is coaxial with the developing roller 18, and is composed of a first cylindrical portion 18*b* and a second cylindrical portion 18*c*, the outer diameters of which are smaller in the stated order. The first cylindrical portion 18*b* is provided with a spacer roller 53 being a ring-shaped distance regulating member for regulating the opposed distance between the developing roller 18 and the photosensitive body drum 11. The spacer roller 53 is made from an insulating material, such as polycetal or the like. A developing bearing frame body 55 (its especially enlarged perspective view seen from the reverse side is shown in FIG. 14) for supporting the developing roller 18 rotatably and locating it to the developing frame body 17 is disposed around the second cylindrical portion 18*c*. Moreover, two flat surfaces 18*d* are formed at the tip portion of the second cylindrical portion 18*c*, and a developing roller gear 54 made from a synthetic resin is fitted to the cylindrical portion 18*c* having the flat surfaces 18*d*. The developing roller gear 54 is driven by a helical drum gear (not shown) provided at an edge portion of the photosensitive body drum 11 to rotate the developing roller 18. The helical teeth of the drum gear are twisted such that the thrust thereof in the axial direction thereof works in the lengthwise direction of the developing roller 18. Moreover, a magnet roller (designated by a reference numeral 18*a* in FIG. 17A) for making toner adhere to the peripheral surface of the developing roller 18 is built in the developing roller 18. Because the sleeve flange on the other end portion of the developing roller 18 has a similar configuration, the descriptions thereof is omitted here. The developing bearing frame body 55 is made from a resin material producing a good slidable property, and is shaped to be a flat plate having a thickness of about 2 mm to 5 mm. At approximately the center of the flat plate portion, a cylindrical bearing portion 55*a* is formed. The inner diameter of the bearing portion 55*a* is 8 mm to 15 mm. The bearing portion 55*a* fits to the second cylindrical portion 18*c* of the sleeve flange 18*s*, and thereby the developing roller 18 slides therein while rotating. Moreover, a dowel 55*c* including a first step portion 55*d*, and a second step portion 55*e* at its end portion, both being for locating the developing bearing frame body 55 against the developing frame body 17, is formed on the surface 55*g* of the flat plate portion of the developing bearing frame body 55 in substantially parallel with the bearing portion 55*a*. The dowel 55*c* performs the role of locating the developing bearing frame body 55 against the developing frame body 17. The first step portion 55*d* and the second step portion 55*e*, both being coaxial with the dowel 55*c* at the end portion of the dowel 55*c* are used for the location of the magnetic seal 50, which will be described later. Moreover, on the same surface 55*g*, tapped holes 55*b* for the fixation of the developing bearing frame body 55 to the developing frame body 17 with machine screws 56 or the like, and a dowel 55*f* for the location of the developing bearing frame body 55 to the developing frame body 17 are formed. The dowel 55*c* of the developing bearing frame body 55 is fitted into a location hole 17*c* (shown in FIG. 14) formed in the developing frame body 17, and the dowel 55*f* is fitted into a fitting elongated hole 17*o* formed in e developing frame body 17, and further the surface 55*g* of the developing bearing frame body 55 is touched to a surface 17*p* of the developing frame body 17. Then, the machine screws 56 are screwed into female screws 17*q* and 17*r* formed on the developing frame body 17 through the two tapped holes 55*b*, and the developing bearing frame body 55 is fixed to the developing frame body 17. Thereby, the positions of the developing blade 26 and the developing roller 18, both being fixed to the developing frame body 17, are surely determined, and stable images can be outputted.

Because the developing roller 18 slides in the bearing portion 55*a* of the developing bearing frame body 55 mentioned above, the material of the developing bearing frame body 55 is preferably a comparatively high priced material having a good sliding property (for example, a bearing material based on poly phenylene sulfide (PPS) or polyamide (PA)). Accordingly, as shown in FIG. 15, if only a bearing portion is separated from a housing 100 as a bearing bushing 101, the quantity of the expensive material to be used is not needed so much, and the housing 100 can be made from a comparatively cheap material such as high-impact polystyrene (HIPS).

Magnetic Seal

The magnetic seal 50 (shown in an especially enlarged figure in FIG. 13) is an injection-molded article having a width of 3 mm to 4 mm. A magnet 50*a* being a component of the magnetic seal 50 includes Nd—Fe—B magnetic power with a nylon binder. A magnetic plate 50*b* being another component of the magnetic seal 50 is made from iron and has a thickness of 1 mm to 1.5 mm. The magnet 50*a* and the magnetic plate 50*b* are molded by the insert molding such that the magnetic plate 50*b* is embedded in the magnet 50*a* except for the remaining inner periphery and the outside side face of the magnet 50. However, the joining by an adhesive, the joining by a pressure sensitive adhesive double coated tape, or the attraction joining only by a magnetic force can similarly bring about the advantages that will be described later. Moreover, the gap between the developing roller 18 and the magnetic seal 50 is 0.1 mm to 0.7 mm, and the magnetic flux density on the surface of the developing roller 18 owing to the magnetic force of the magnetic seal 50 in this case is about 1,000 Gs to 2,000 Gs. Then, as shown in FIG. 16, in the state such that two magnetic seals 50 are fixed to the developing frame body 17, the magnets 50*a* of the two magnetic seals 50 are located to be opposed to each other.

By the disposition of the two magnetic seals 50 in the way described above, the lines of magnetic forces 75 of each of the magnetic seals 50 are formed between the magnet 50*a* and the magnetic plate 50*b* to enter into the magnetic plate 50*b* having a higher permeability as shown in FIG. 17B, which is a macrograph of the part of 17B in FIG. 17A. Consequently, no lines of magnetic forces expand to the outside of the width of the magnetic seal 50.

Consequently, toner diffusing along the lines of magnetic forces 75 on the surface of the magnetic seal 50 does not exist on the outside of the magnetic plate 50*b* on the side of the magnetic plate 50*b* (or the outside of the opening portion 17*a*). The phenomenon such that toner is touched to the spacer roller 53 being a distance regulating member owing to the rotations of the developing roller 18 does not happen. Consequently, the spacer roller 53 can be approached to the side face of the magnetic seal 50, and thereby naturally the process cartridge 15 can be miniaturized, and the apparatus main body C can also be miniaturized.

Moreover, because the toner on the magnetic seal 50 does not diffuse to the outside of the opening portion 17*a* of the developing frame body 17 from the magnetic plate 50*b*, the toner can securely be held within a range where the magnetic force on the surface of the magnetic seal 50 is strong. Consequently, a good seal property such that toner does not leak out even if impact or the like is imposed on the process cartridge 15 when a user attaches or detaches the process cartridge 15 to the apparatus main body C can be obtained.

Moreover, the fact that the lines of magnetic forces 75 enter into the magnetic plate 50*b* by the disposition of the magnetic plate 50*b* on the side face of the magnet 50*a* is to converge the lines of magnetic forces 75, which has the tendency of divergence, into the magnetic plate 50*b*. Consequently, the magnetic flux density on the surface of the magnet 50*a* becomes large, which makes the magnetic force of the magnet 50 large. Hence, it is achieved to improve the sealing property furthermore. In addition, because a cheap magnet, which has a small magnetic force, can be used if the sealing property is not needed so strictly, the cost of the process cartridge 15 can be decreased.

Location Configuration of Magnetic Seal

The magnetic seal 50 is located to the developing roller 18 by means of the developing frame body 17, the elastic seal member 51 and the developing bearing frame body 55, all being described above. That is, the magnetic seal 50 is located by a location hole 50*d* of the magnetic seal 50 shown in FIG. 9 and by the biasing of the magnetic seal 50 in the rotation direction around the location hole 50*d*. The location is described on the basis of FIG. 8, FIG. 9, FIG. 10, FIG. 11 and FIG. 13 in detail.

As shown in FIG. 9, both the magnet 50*a* and the magnetic plate 50*b* have a half arc portion 50*e* (or the half arc portion of the magnetic seal 50), the inner periphery side of which forms a gap g1 with the developing roller 18, and an end face portion 50*c*, which offsets to the side of he developing frame body 17 halfway on the half arc portion 50*e* to extend upward in a straight line from the upper part of he half arc portion 50*e*. The cross section of the magnet 50*a* is nearly a square, and the cross section of the magnet 50*a* combined with the magnetic plate 50*b* is a square. An arc-shaped bending portion 50*h* projects towards the outside in the radial direction from the outer periphery 50*f* of the magnet 50*a*, and the location hole 50*d* is exists at the center of the arc of the bending portion 50*h*. As shown in FIG. 13, the upper end of the magnetic plate 50*b* is fitted into the end face portion 50*c*, and the magnet 50*a* and the magnetic plate 50*b* form the same plane on the outside side face of the magnetic seal 50 in the lengthwise direction.

As shown in FIG. 9 and FIG. 12, a groove 17*k* (17*k*1, 17*k*2 and 17*k*3) for the attachment of the magnetic seal 50 is formed from the anti-climbing plane 17*f*, to which the developing blade 26 is attached, to an adjoining position to the arc surface 17*l* along an end portion of the developing roller 18. The groove 17*k* is composed of an arc groove 17*k*1 along the arc of the arc surface 17*l* (see FIG. 12), a straight line groove 17*k*2 along the anti-climbing plane 17*f* in a vertical direction, and a location groove 17*k*3, in which the bending portion 50*h* (the inner periphery of which forms the location hole 50*d*) of the magnetic seal 50 is just fitted. These grooves 17*k*1, 17*k*2 and 17*k*3 are continuously formed. The location groove 17*k*3 is recessed from the base of the arc groove 17*k*1. The width H (noted in FIG. 10) of the groove 17*k* and the width of the magnetic seal 50 are formed to be the same. And, the magnetic seal 50 is fitted into the groove 17*k*. Thereby, the position of the magnetic seal 50 to the developing roller 18 in the lengthwise direction of the developing roller 18 is determined. Moreover, the depth of each portion of the groove 17*k* for the attachment of the magnetic seal 50 thereto is deeper than the thickness of each corresponding portion of the magnetic seal 50 by 0.1 mm to 0.7 mm when the magnetic seal 50 is fitted into a predetermined position (the fitting will be described later). That is, the surface of the outer periphery 50*f* of the magnetic seal 50 keeps a gap g2 (see FIG. 9) from the groove 17*k* of the developing frame body 17. For the prevention of the leakage of toner through the gap g2, a magnetic pole is disposed on the surface of the outer periphery 50*f* of the magnetic seal 50 as a magnetic pole is disposed on the surface opposed to the developing roller 18, and the leakage of toner to the outside can be prevented by the magnetic force caused by the magnetic pole. Moreover, the magnetic seal 50 may be configured such that the magnetic plate 50*b* is extended to the surface of the outer periphery 50*f* to prevent the leakage of the magnetic force to the outside likewise on the developing roller 18 side for heightening the effect of the magnetic force.

Next, the location of the magnetic seal 50 is described in detail. As shown in FIG. 10, the first step portion 55*d* at the end of the dowel (or a shaft) 55*c* projecting from the developing bearing frame body 55 described above is fitted into the location hole 50*d* of the magnetic seal 50, and thereby the magnetic seal 50 is rotatably supported around the first step portion 55*d*. Moreover, the second step portion 55*e* at the end of the fist step portion 55*d* is fitted into a location hole 17*s*, which is coaxial with the location hole 17*c* of he developing frame body 17 and is formed on the side opposed to the groove 17*k*. Thereby, both the end faces of the magnetic seal 50 are supported. Because the magnetic seal 50 is supported at both the end faces, even if the shaft for location is slender in some degree, the magnetic seal 50 can be supported with a sufficient strength. Thereby, the space of the magnetic seal 50 can be reduced. Furthermore, although the dowel 55*c* being a location shaft easily falls in its formation process by molding, it is comparatively attained by molding to locate the center positions of the location holes 17*c* and 17*s* of the developing frame body 17 on the same axis precisely. Consequently, the location of the magnetic seal 50 can precisely be performed.

Next, the location of the magnetic seal 50 in its rotation direction is, as shown in FIG. 9, performed by the contact thereof to a lower end face 17*k*4 of the arc groove 17*k*1 of the developing frame body 17, i.e. an end face 17*k*4 falling down from the seat surface 17*m*1 with an elastic seal (not shown) at the lower jaw portion 17*m* described above. Moreover, a biasing force F for contacting the magnetic seal 50 to the end face 17*k*4 surely is caused by a repulsive force generated by the compression of mainly the lug portion 51*b* (see FIG. 12) of the elastic seal member 51 lying between the portion of the end face 50*c* in a straight line at the upper part of the magnetic seal 50 and the sheet metal 26*a* of the developing blade 26. Thus the biasing force F works on the magnetic seal 50 in the clockwise direction around the location hole 50*d*, and thereby the magnetic seal 50 is surely located to the developing roller 18. Moreover, only the developing bearing frame body 55 exists between the magnetic seal 50 and the developing roller 18, and consequently the dispersion of the length of the gap g1, which generally becomes large by the accumulation of tolerances, is suppressed to be as small as possible. Consequently, the allowance for the leakage of toner can be improved. Moreover, although the gap g1 has conventionally been measured during a manufacturing process, the examination of the gap g1 becomes unnecessary because the accumulation of tolerances becomes small. Moreover, the biasing force F is produced by means of a part of the elastic seal member 51, and thereby the location of the magnetic seal 50 can surely be performed at low cost without surplus parts. Furthermore, the elastic seal member 51 uses an insulating material, and thereby the elastic seal member 51 also performs the role of preventing leakage of a voltage when a high voltage is not desired to be applied to the sheet metal 26*a* of the developing blade 26, for example.

Next, the assembly of the magnetic seals 50 until their positions are determined is described on the basis of FIG. 12.

As shown in FIG. 12, the magnetic seals 50 are brought into the grooves 17*k* of the developing frame body 17 for the attachment of the magnetic seals 50 as indicated by an arrow D. Then, the half arc portions 50*e* of the magnetic seals 50 are fitted into the arc grooves 17*k*1, and the end face portions 50*c* are fitted into the straight line grooves 17*k*2. After that, the magnetic seals 50 are pushed into the arc grooves 17*k*1 and the straight line grooves 17*k*2 until the inner peripheral surfaces of the half arc portions 50*e* are at substantially the same heights as those of the arc surfaces 171. Next, the first straight line portion 51*c* of the elastic seal member 51 is stuck to the elastic seat surface 17*h* being the end face of a rib of the developing frame body 17 in the lengthwise direction, and the second straight line portions 51*a* are stuck to the seat surfaces 17*j* of the developing frame body 17. And further, the lug portions 51*b* are stuck to the end face portions 50*c* of the magnetic seal 50. At this time, because the heights of the elastic seal seat surface 17*h* and the magnetic seal 50 are different from each other, the elastic seal member 51 is not easy for such to stick together (see FIG. 11). For making it easy to stick the elastic seal member 51, a tapered plane 50*g* (shown in FIG. 13) is formed. Moreover, the lug portions 51*b* and the second straight line portions 51*a* may be formed to be separate bodies in view of material allotting. As for the incorporation of the developing blade 26, as described above, the fitting holes 26*d* formed in the sheet metal 26*a* are fitted to each of their respective dowels (not shown). After that, the machine screws 57 are screwed into the female screws 17*g* through the tapped holes 26*c* formed in the sheet metal 26*a* to fix the sheet metal 26*a* to the anti-climbing planes 17*f*. Next, the unit of the developing roller 18 is temporarily put in the developing frame body 17 to be coaxial with the half arc portions 50*e* of the magnetic seals 50. At this time, the developing roller 18 does not directly contact with the magnetic seals 50 owing to the repulsive force of the polyurethane rubber 26*b* of the developing blade 26, and consequently the surface of the developing roller 18 is not injured by the magnetic seals 50.

Lastly, the developing bearing frame bodies 55 are assembled from both side face sides of the developing frame body 17 (though FIG. 12 shows one end side of the developing frame body 17, the other end side thereof is in the same configuration). That is, as described above by reference to FIG. 14, the dowels 55*f* are fitted into the fitting elongated holes 17*o* (which are elongated in the up and down direction in parallel to the surface of the sheet of FIG. 10), and further the surfaces 55*g* of the developing bearing frame bodies 55 are touched to the surfaces 17*p* of the developing frame body 17. Then, the machine screws 56 are screwed into the female screws 17*q* and 17*r* formed on the surfaces 17*p* through the tapped holes 55*b* formed in the developing bearing frame bodies 55, and the developing bearing frame bodies 55 are fixed to the developing frame body 17. Thereby, the magnetic seals 50 are located around the first step portions 55*d* in the states of being able to tilt. The magnetic seals 50 receive moments around the first step portions 55*d* by forces biased by the repulsive force of the elastic seal member 51 lying between the magnetic seals 50 and the developing blade 26, and the lower end faces of the magnetic seals 50 are touched to the lower end faces 17*k*4 of the grooves 17*k* of the developing frame body 17.

As described above, the positions of the magnetic seals 50 to the developing roller 18 are surely determined by a simple assembling method.

The present invention is not bounded to the aforesaid embodiments, and many modifications within the scope of the technical concepts of the present invention can be included therein.

What is claimed is:

1. A developing apparatus comprising:

a rotatable developer bearing member;

a bearing member for rotatably holding said developer bearing member; and a seal member for preventing leakage of a developer from an end portion of said developer bearing member in a lengthwise direction thereof, wherein said developer bearing member includes a shaft for locating said seal member rotatably, and said seal member includes a hole into which said shaft is fitted, and wherein said seal member is proximate to said bearing member.

2. A developing apparatus according to claim 1, wherein said seal member is disposed along a peripheral surface of said end portion of said developer bearing member in the lengthwise direction.

3. A developing apparatus according to claim 1, further comprising locating means for determining a position of said seal member in a rotation direction thereof around said shaft.

4. A developing apparatus according to claim 3, wherein said locating means includes biasing means for biasing said seal member in the rotation direction, and a receiving portion for receiving said seal member biased by said biasing means.

5. A developing apparatus according to claim 4, further comprising:

a regulating member for regulating a quantity of the developer to be borne by said developer bearing member; and an elastic member provided between said regulating member and said seal member, wherein said regulating member and said elastic member cooperate to function as said biasing means.

6. A developing apparatus according to claim 5, wherein said elastic member has an insulating property.

7. A developing apparatus according to claim 5, wherein said elastic member is made of foam urethane.

8. A developing apparatus according to claim 1, wherein said seal member is attached to a main body of said developing apparatus from a direction crossing with the lengthwise direction, and said bearing member is attached to said main body from a direction parallel with the lengthwise direction.

9. A developing apparatus according to claim 1, wherein, when said bearing member is attached to a main body of said developing apparatus, said shaft passes through a first hole formed in said main body, then passes through said hole of said seal member, and then enters into a second hole formed in said main body.

10. A developing apparatus according to claim 9, wherein said shaft comprises a stepped shaft including a slender end portion.

11. A developing apparatus according to claim 1, wherein said seal member magnetically prevents the developer from leaking from said apparatus.

12. A developing apparatus according to claim 1, wherein said developing apparatus is provided in a process cartridge, which includes at least a photosensitive body and is detachably attachable to an image forming apparatus.

* * * * *

UNITED STATES PATENT AND TRADEMARK OFFICE

CERTIFICATE OF CORRECTION

PATENT NO. : 6,671,473 B2
DATED : December 30, 2003
INVENTOR(S) : Shigeo Miyabe

It is certified that error appears in the above-identified patent and that said Letters Patent is hereby corrected as shown below:

Column 9,
Line 23, “e” should read -- the --.

Column 10,
Line 47, “to” should read -- on --.

Column 11,
Line 1, “exists” should be deleted; and
Line 64, “on the source axis precisely.” should read -- precisely on the same axis. --.

Column 12,
Line 46, “seal seat” should read -- seat --.

Signed and Sealed this

Eighth Day of June, 2004

JON W. DUDAS
*Acting Director of the United States Patent and Trademark Office*